US008297332B2

(12) United States Patent
Lin

(10) Patent No.: US 8,297,332 B2
(45) Date of Patent: Oct. 30, 2012

(54) AUTO WINDING MECHANISM FOR WINDOW BLIND

(76) Inventor: Shih-Ming Lin, Jiayi (TW)

( * ) Notice: Subject to any disclaimer, the term of this patent is extended or adjusted under 35 U.S.C. 154(b) by 0 days.

(21) Appl. No.: 13/015,676

(22) Filed: Jan. 28, 2011

(65) Prior Publication Data

US 2012/0193461 A1 Aug. 2, 2012

(51) Int. Cl.
*E06B 9/30* (2006.01)

(52) U.S. Cl. ..... 160/170; 160/84.04; 160/173 R

(58) Field of Classification Search ..... 160/170, 160/167 R, 167 V, 168.1 R, 315, 178.2, 192
See application file for complete search history.

(56) References Cited

U.S. PATENT DOCUMENTS 5,482,100 A * 1/1996 Kuhar ..... 160/170
5,531,257 A * 7/1996 Kuhar ..... 160/168.1 P
6,474,394 B2 * 11/2002 Kuhar ..... 160/170
6,508,293 B1 * 1/2003 Huang ..... 160/170
6,761,203 B1 * 7/2004 Huang ..... 160/170
6,837,294 B2 * 1/2005 Cheng et al. ..... 160/84.04
7,168,476 B2 * 1/2007 Chen ..... 160/170
7,281,563 B2 * 10/2007 Wu ..... 160/170
7,343,957 B2 * 3/2008 Lin ..... 160/168.1 R
7,717,154 B2 * 5/2010 Cheng ..... 160/170
2004/0154758 A1 * 8/2004 Cheng et al. ..... 160/170
2006/0096719 A1 * 5/2006 Wu ..... 160/170
2006/0137830 A1 * 6/2006 Lin ..... 160/84.04
2006/0283560 A1 * 12/2006 Lai ..... 160/168.1 R
2007/0163727 A1 * 7/2007 Cheng et al. ..... 160/170
2008/0277075 A1 * 11/2008 Cheng ..... 160/167 R
2008/0277076 A1 * 11/2008 Cheng ..... 160/167 R
2009/0283223 A1 * 11/2009 Liu ..... 160/84.02
2009/0283226 A1 * 11/2009 Cheng ..... 160/313

* cited by examiner

*Primary Examiner* — Katherine W Mitchell
*Assistant Examiner* — Johnnie A Shablack
(74) *Attorney, Agent, or Firm* — Alan Kamrath; Kamrath IP Lawfirm, PA

(57) ABSTRACT

An auto winding mechanism for a window blind includes two guide rollers pivotally mounted between an upper seat and a lower seat and connected by an elastic winding tape, and two pull cords wound around the pull cords. Each of the guide rollers has a gear and a bottom disk. The upper seat has a covering edge surrounding the gear of each of the guide rollers. The lower seat has a surface provided with two annular grooves to receive the bottom disk of each of the two guide rollers. Thus, each of the pull cords is protected by the bottom disk of each of the guide rollers so that when the pull cords swing or bump during movement, each of the pull cords will not be jammed between the lower seat and each of the guide rollers.

8 Claims, 9 Drawing Sheets

AUTO WINDING MECHANISM FOR WINDOW BLIND

BACKGROUND OF THE INVENTION

1. Field of the Invention

The present invention relates to a winding mechanism and, more particularly, to an auto winding mechanism for a window blind.

2. Description of the Related Art

A conventional auto winding mechanism for a window blind in accordance with the prior art shown in FIGS. 1 and 2 comprises an upper seat 40, a lower seat 41 connected with the upper seat 40, two guide rollers 45 pivotally mounted between the upper seat 40 and the lower seat 41, and two pull cords 44 wound around the two guide rollers 45 in two opposite directions. The two guide rollers 45 are connected by a S-shaped elastic winding tape 42. Each of the two guide rollers 45 has an upper end connected with the elastic winding tape 42 and a lower end connected with a respective one of the two pull cords 44. Each of the two guide rollers 45 has a periphery provided with a gear 43, and the gears 43 of the two guide rollers 45 mesh with each other so that the two guide rollers 45 are rotated in concert with each other.

When in use, the auto winding mechanism is mounted on a window blind. The window blind includes a headrail, and a plurality of shading members. The auto winding mechanism is mounted in the headrail of the window blind, and the two pull cords 44 are in turn extended through two opposite ends of each of the shading members to connect and draw the shading members. The elastic winding tape 42 provides an elastic force to support the weight of the shading members to reach a balance state. When the shading members are pulled by a user, the two pull cords 44 are pulled outward and downward to drive and rotate the two guide rollers 45 and to stretch the elastic winding tape 42 so as to store a restoring force. Thus, the user can directly pull and draw the shading members to lift or lower the shading members and to stop the shading members at any position.

However, when the pull cords 44 are moved rapidly, the pull cords 44 will easily swing upward and downward or bump so that the pull cords 44 are easily clamped or jammed between the lower seat 41 and the guide rollers 45, thereby causing the auto winding mechanism to be inoperative.

BRIEF SUMMARY OF THE INVENTION

In accordance with the present invention, there is provided an auto winding mechanism for a window blind, comprising an upper seat, a lower seat connected with the upper seat, two guide rollers pivotally mounted between the upper seat and the lower seat, and two pull cords wound around the two pull cords in two opposite directions. The two guide rollers are connected by a S-shaped elastic winding tape. Each of the two guide rollers has an upper end connected with the elastic winding tape and a lower end connected with a respective one of the two pull cords. Each of the two guide rollers has a periphery provided with a gear, and the gears of the two guide rollers mesh with each other so that the two guide rollers are rotated in concert with each other. Each of the two guide rollers has a bottom provided with a bottom disk. The upper seat has a bottom provided with a covering edge surrounding the gear of each of the two guide rollers. The upper seat has a surface provided with two pivot holes. The lower seat has a surface provided with two annular grooves to receive the bottom disk of each of the two guide rollers and provided with two shafts extending through the two guide rollers and aligning with the two pivot holes of the upper seat. Each of the two shafts of the lower seat is located in a respective one of the two annular grooves of the lower seat.

The two guide rollers are pivotally mounted on the two shafts of the lower seat with the gears of the two guide rollers meshing with each other. The bottom disk of each of the two guide rollers is then pivotally mounted in a respective one of the two annular grooves of the lower seat. The upper seat is then mounted on the lower seat, with the two pivot holes of the upper seat aligning with the two shafts of the lower seat, and with the covering edge of the upper seat surrounding the gear of each of the two guide rollers. The two pivot holes of the upper seat and the two shafts of the lower seat are then connected so that the upper seat is combined with the lower seat.

According to the primary advantage of the present invention, each of the two pull cords is protected by the bottom disk of each of the two guide rollers so that when the two pull cords swing or bump during movement, each of the two pull cords will not be clamped or jammed between the lower seat and each of the two guide rollers.

According to another advantage of the present invention, the covering edge of the upper seat covers the gear of each of the two guide rollers to prevent each of the two pull cords from directly contacting the gear of each of the two guide rollers, so that each of the two pull cords will not be jammed during movement.

According to a further advantage of the present invention, the elastic winding tape is covered by the covering edge of the upper seat so that the elastic winding tape is operated smoothly and stably.

According to a further advantage of the present invention, the two guide rollers are pivotally mounted on the two shafts of the lower seat, and the bottom disk of each of the two guide rollers is pivotally mounted in the respective annular groove of the lower seat so that the two guide rollers will not be vibrated or deflected by the two pull cords and will be rotated smoothly and stably by guidance of the two shafts and the two annular grooves of the lower seat.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
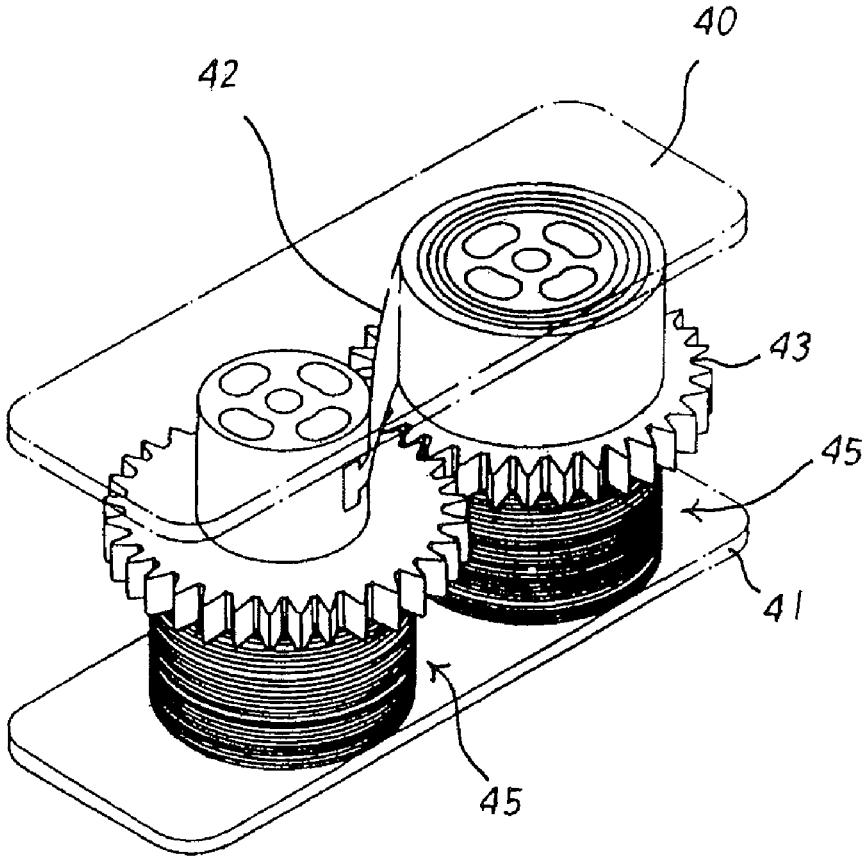
FIG.1 PRIOR ART
FIG. 1 is a perspective view of a conventional auto winding mechanism for a window blind in accordance with the prior art.
Figure 2:
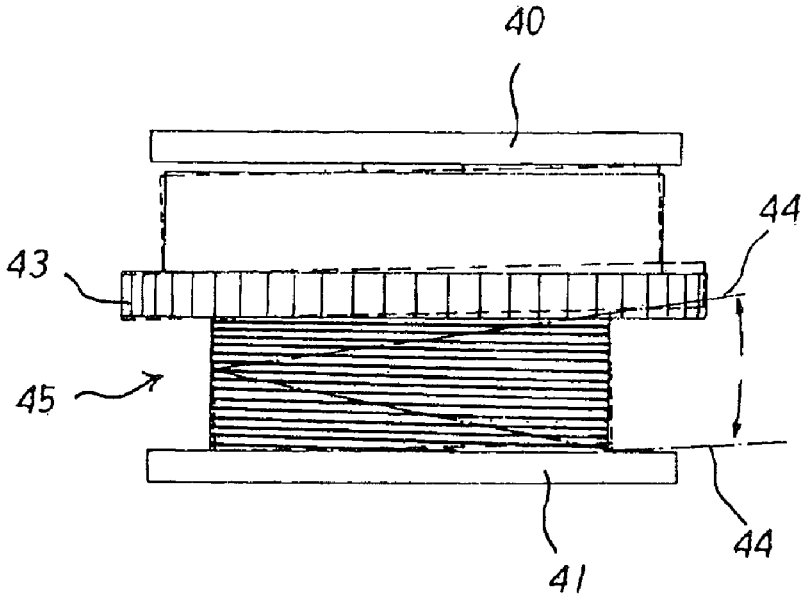
FIG. 2 PRIOR ART
FIG. 2 is a schematic side operational view of the conventional auto winding mechanism for a window blind as shown in FIG. 1.
Figure 3:
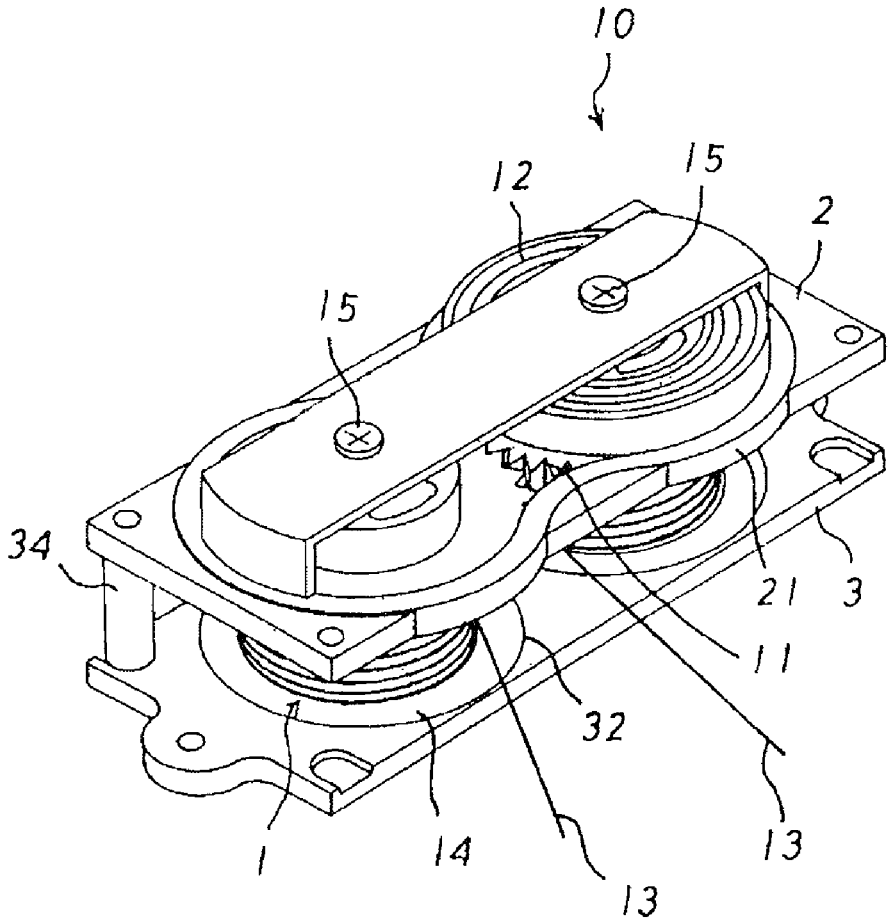
FIG. 3 is a perspective view of an auto winding mechanism for a window blind in accordance with the preferred embodiment of the present invention.
Figure 4:
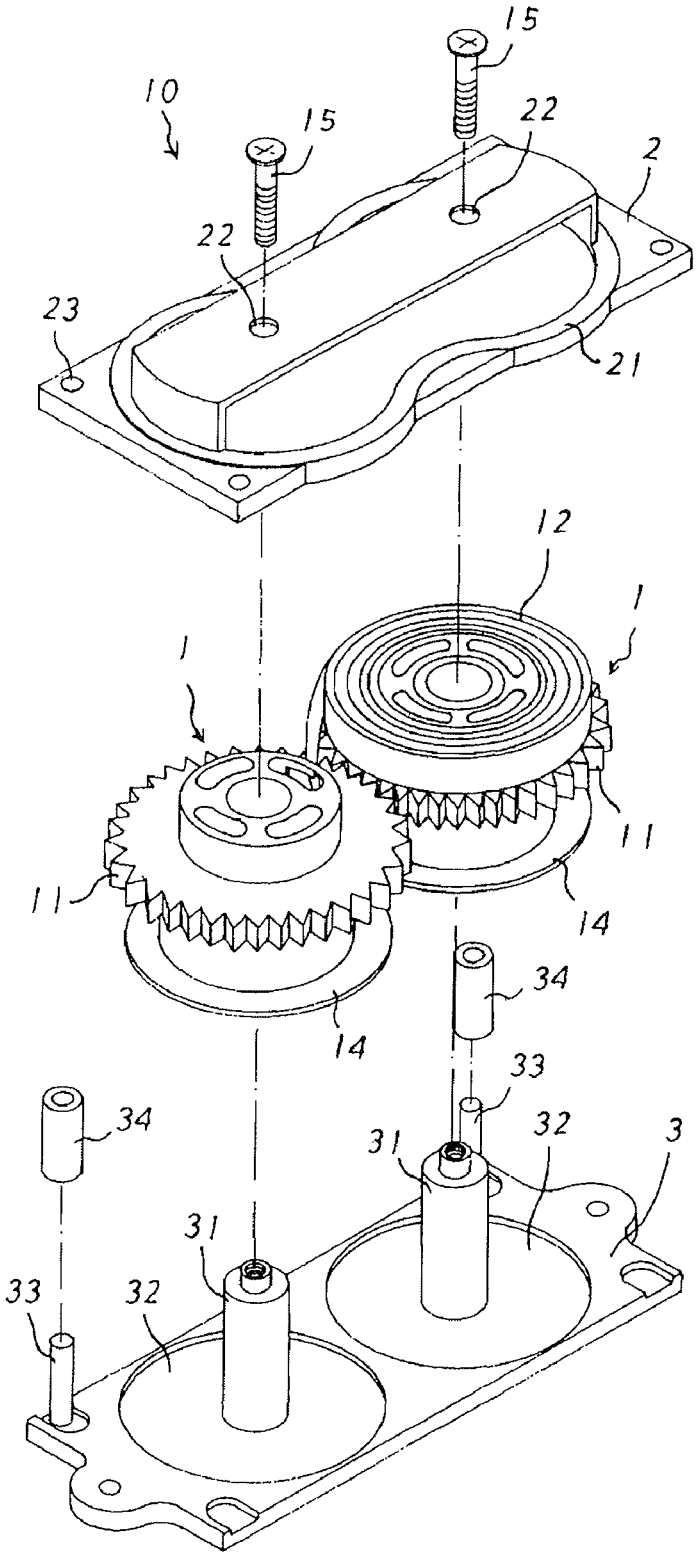
FIG. 4 is an exploded perspective view of the auto winding mechanism for a window blind as shown in FIG. 3.
Figure 5:
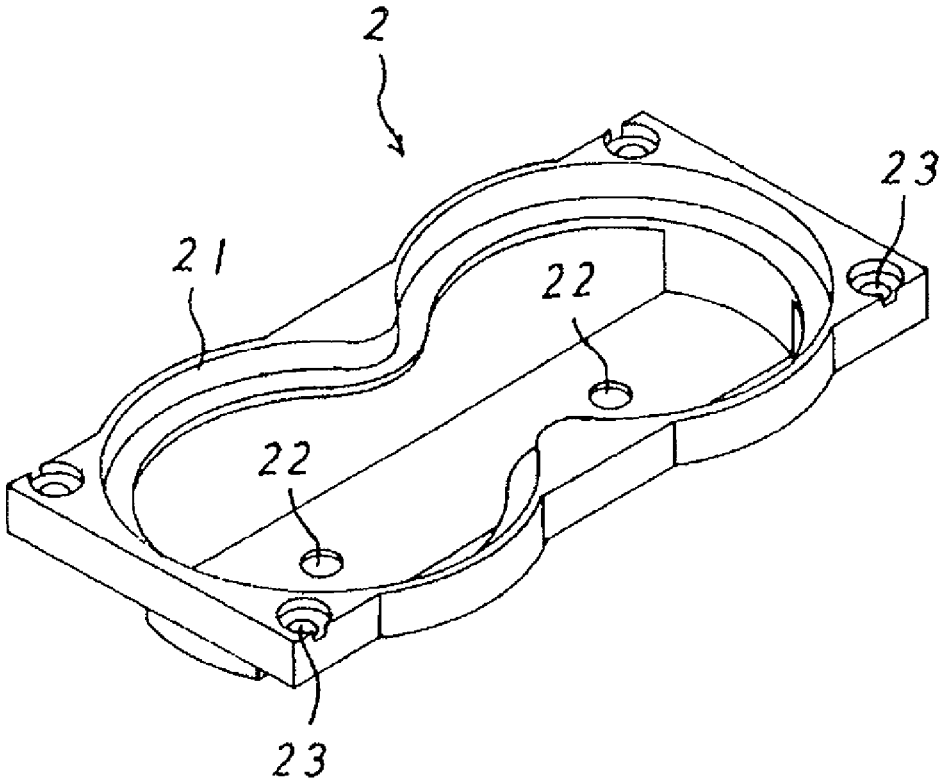
FIG. 5 is a perspective view of an upper seat of the auto winding mechanism for a window blind as shown in FIG. 4.

Referring to the drawings and initially to FIGS. 3-5, an auto winding mechanism 10 for a window blind in accordance with the preferred embodiment of the present invention comprises an upper seat 2, a lower seat 3 connected with the upper seat 2, two guide rollers 1 pivotally mounted between the upper seat 2 and the lower seat 3, and two pull cords 13 wound around the two pull cords 13 in two opposite directions.

The two guide rollers 1 are connected by a S-shaped elastic winding tape 12. Each of the two guide rollers 1 has an upper end connected with the elastic winding tape 12 and a lower end connected with a respective one of the two pull cords 13. Each of the two guide rollers 1 has a periphery provided with a gear 11, and the gears 11 of the two guide rollers 1 mesh with each other so that the two guide rollers 1 are rotated in concert with each other. Each of the two guide rollers 1 has a bottom provided with a bottom disk 14.

The upper seat 2 has a bottom provided with a covering edge 21 surrounding the gear 11 of each of the two guide rollers 1. The upper seat 2 has a surface provided with two pivot holes 22.

The lower seat 3 has a surface provided with two annular grooves 32 to receive the bottom disk 14 of each of the two guide rollers 1 and provided with two shafts 31 extending through the two guide rollers 1 and aligning with the two pivot holes 22 of the upper seat 2. Each of the two shafts 31 of the lower seat 3 is located in a respective one of the two annular grooves 32 of the lower seat 3.

In assembly, the two guide rollers 1 are pivotally mounted on the two shafts 31 of the lower seat 3 with the gears 11 of the two guide rollers 1 meshing with each other. At this time, the bottom disk 14 of each of the two guide rollers 1 is pivotally mounted in a respective one of the two annular grooves 32 of the lower seat 3. Then, the upper seat 2 is mounted on the lower seat 3, with the two pivot holes 22 of the upper seat 2 aligning with the two shafts 31 of the lower seat 3, and with the covering edge 21 of the upper seat 2 surrounding the gear 11 of each of the two guide rollers 1. Then, the two pivot holes 22 of the upper seat 2 and the two shafts 31 of the lower seat 3 are connected by two fastening screws 15 so that the upper seat 2 is combined with the lower seat 3.

In the preferred embodiment of the present invention, the bottom disk 14 of each of the two guide rollers 1 has a diameter greater than a winding diameter of each of the two pull cords 13 around each of the two guide rollers 1. The lower seat 3 has a periphery provided with a plurality of mounting posts 33, the upper seat 2 has a periphery provided with a plurality of through holes 23 mounted on the mounting posts 33 of the lower seat 3, and the auto winding mechanism 10 further comprises a plurality of mounting sleeves 34 mounted on the mounting posts 33 of the lower seat 3 and located between the upper seat 2 and the lower seat 3 so that the two guide rollers 1 are pivotally mounted between the upper seat 2 and the lower seat 3 stably.

Figure 6:
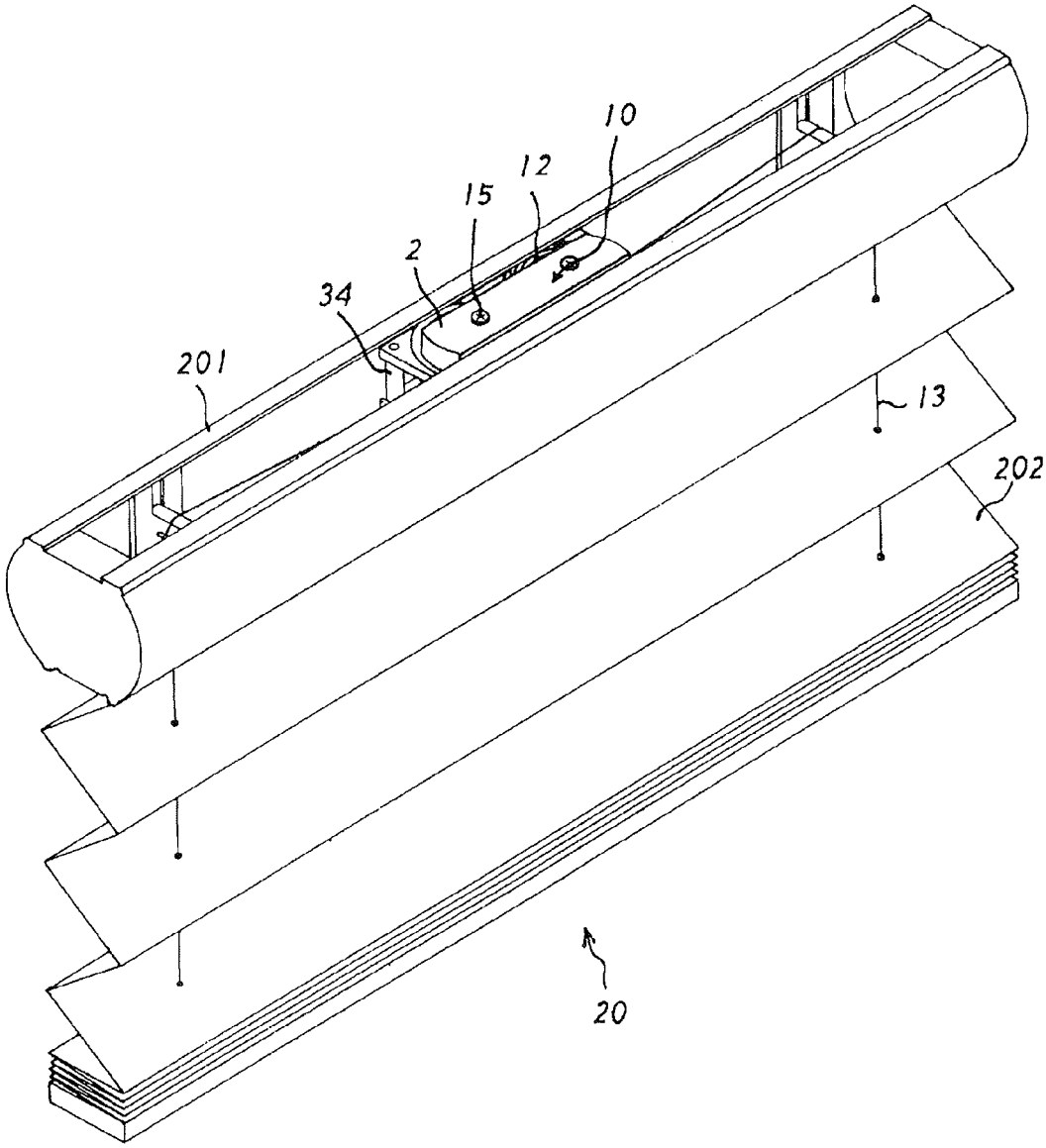
FIG. 6 is a schematic operational view of the auto winding mechanism for a window blind as shown in FIG. 3 in use.
Figure 7:
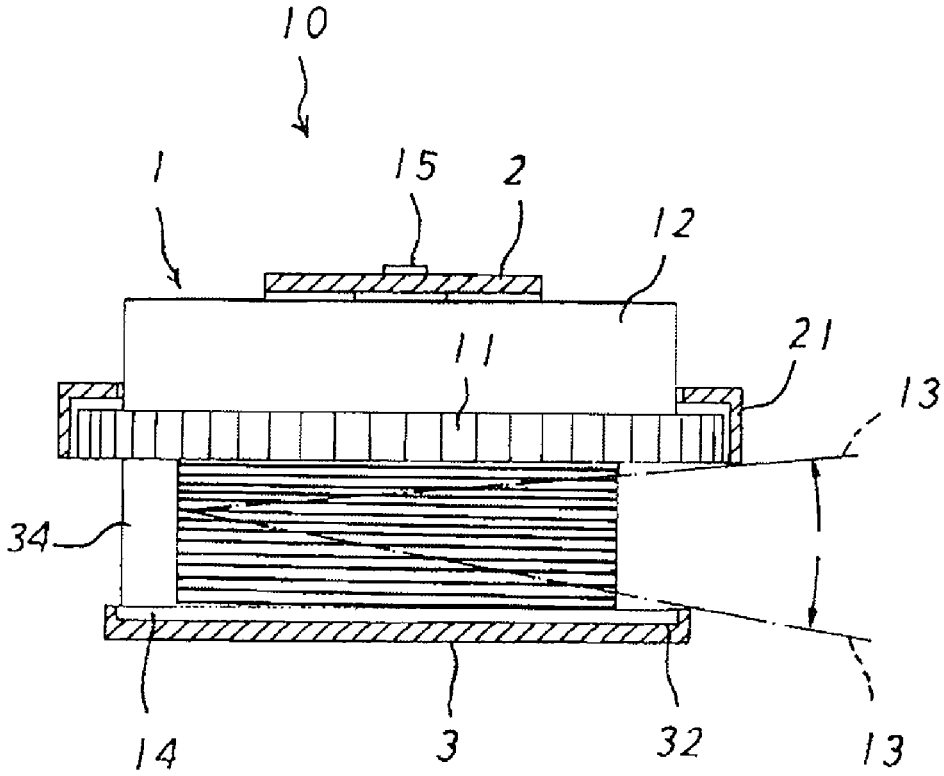
FIG. 7 is a schematic side cross-sectional operational view of the auto winding mechanism for a window blind as shown in FIG. 3.

In operation, referring to FIGS. 6 and 7 with reference to FIGS. 3-5, the auto winding mechanism 10 is mounted on a window blind 20. The window blind 20 includes a headrail 201, and a plurality of shading members 202. Preferably, each of the shading members 202 is a lath or cloth. The auto winding mechanism 10 is mounted in the headrail 201 of the window blind 20, and the two pull cords 13 are in turn extended through two opposite ends of each of the shading members 202 to connect and draw the shading members 202. The elastic winding tape 12 provides an elastic force to support the weight of the shading members 202 to reach a balance state. When the shading members 202 are pulled by a user, the two pull cords 13 are pulled outward and downward to drive and rotate the two guide rollers 1 and to stretch the elastic winding tape 12 so as to store a restoring force. Thus, the user can directly pull and draw the shading members 202 to lift or lower the shading members 202 and to stop the shading members 202 at any position. The operation of the auto winding mechanism 10 is conventional and will not be further described in detail.

When in use, the two pull cords 13 are moved rapidly so that the two pull cords 13 will easily swing upward and downward. At this time, the two guide rollers 1 are pivotally mounted on the two shafts 31 of the lower seat 3, and the bottom disk 14 of each of the two guide rollers 1 is pivotally mounted in the respective annular groove 32 of the lower seat 3 so that the two guide rollers 1 are rotated smoothly and stably by guidance of the two shafts 31 and the two annular grooves 32 of the lower seat 3 and will not be vibrated or deflected by the two pull cords 13 when the two pull cords 13 swing or bump so as to prevent the two pull cords 13 from being clamped or jammed between the lower seat 3 and the two guide rollers 1. In addition, the gear 11 of each of the two guide rollers 1 is covered by the covering edge 21 of the upper seat 2 to prevent each of the two pull cords 13 from being introduced into the gear 11 of each of the two guide rollers 1 so that each of the two pull cords 13 will not be jammed during movement and will be operated smoothly and stably. Further, the elastic winding tape 12 is also covered by the covering edge 21 of the upper seat 2 so that the elastic winding tape 12 is operated smoothly and stably. Further, the mounting sleeves 34 are mounted on the mounting posts 33 of the lower seat 3 and are located between the upper seat 2 and the lower seat 3 so that the two guide rollers 1 are pivotally mounted between the upper seat 2 and the lower seat 3 exactly and stably.

Figure 8:
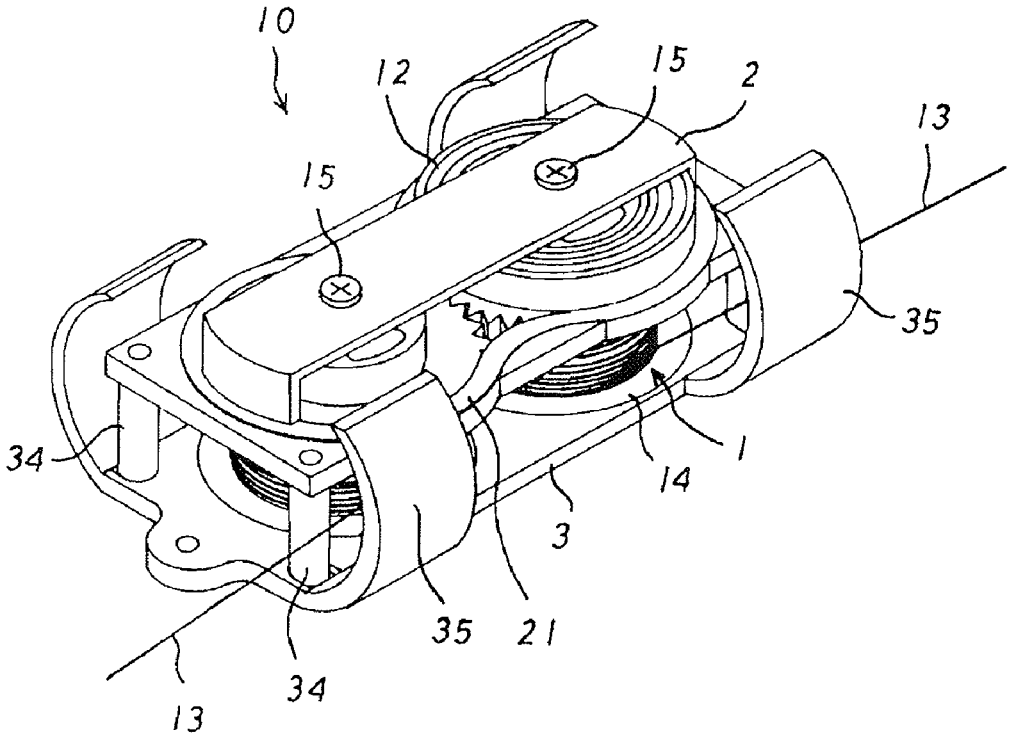
FIG. 8 is a perspective view of an auto winding mechanism for a window blind in accordance with another preferred embodiment of the present invention.

Referring to FIG. 8, the lower seat 3 has a rim provided with a plurality of upward extending limit plates 35 aligning with the mounting sleeves 34, and each of the two pull cords 13 is extended and limited between a respective one of the mounting sleeves 34 and a respective one of the limit plates 35 so that the movement of each of the two pull cords 13 is limited so as to prevent each of the two pull cords 13 from being clamped or jammed between the lower seat 3 and the headrail 201 of the window blind 20.

Figure 9:
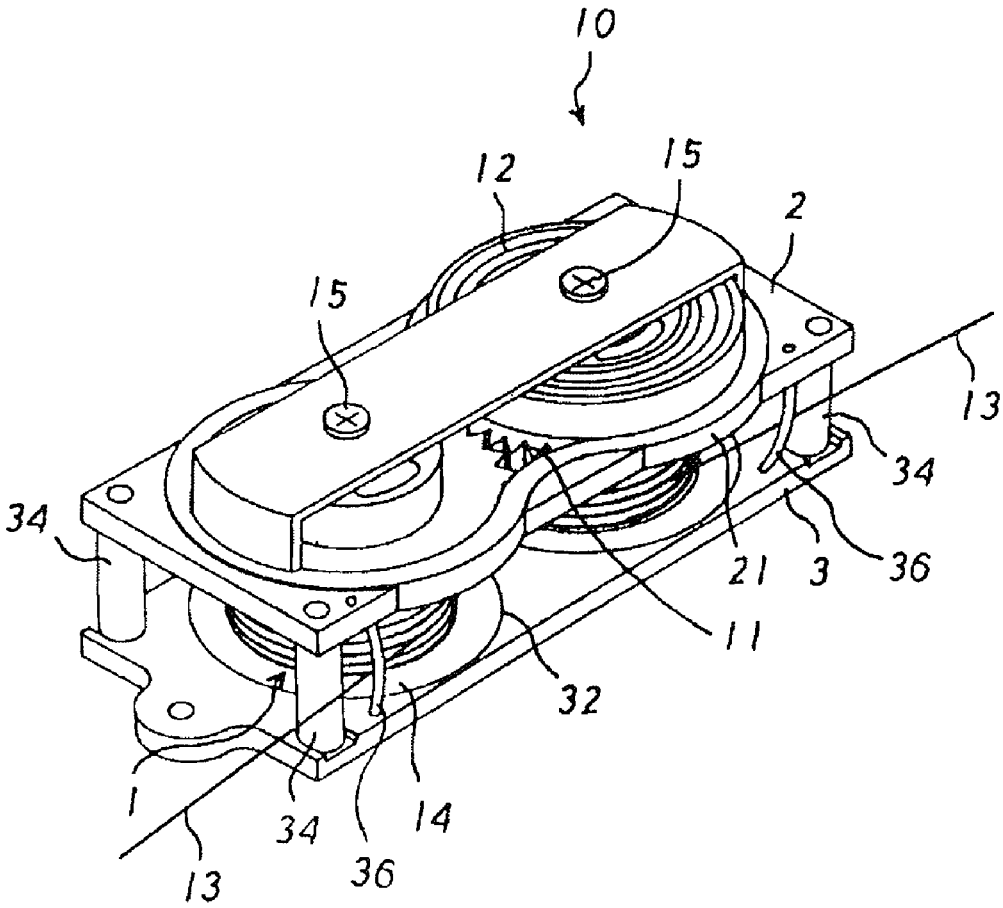
FIG. 9 is a perspective view of an auto winding mechanism for a window blind in accordance with another preferred embodiment of the present invention.

Referring to FIG. 9, the auto winding mechanism 10 further comprises a plurality of curved limiting bars 36 mounted between the upper seat 2 and the lower seat 3 and aligning with the mounting sleeves 34, and each of the two pull cords 13 is extended and limited between a respective one of the mounting sleeves 34 and a respective one of the limiting bars 36 so that the movement of each of the two pull cords 13 is limited so as to prevent each of the two pull cords 13 from being clamped or jammed between the lower seat 3 and the headrail 201 of the window blind 20.

Accordingly, each of the two pull cords 13 is protected by the bottom disk 14 of each of the two guide rollers 1 so that when the two pull cords 13 swing or bump during movement, each of the two pull cords 13 will not be clamped or jammed between the lower seat 3 and each of the two guide rollers 1. In addition, the covering edge 21 of the upper seat 2 covers the gear 11 of each of the two guide rollers 1 to prevent each of the two pull cords 13 from being directly contacting the gear 11 of each of the two guide rollers 1 so that each of the two pull cords 13 will not be jammed during movement. Further, the elastic winding tape 12 is covered by the covering edge 21 of the upper seat 2 so that the elastic winding tape 12 is operated smoothly and stably. Further, the two guide rollers 1 are pivotally mounted on the two shafts 31 of the lower seat 3, and the bottom disk 14 of each of the two guide rollers 1 is pivotally mounted in the respective annular groove 32 of the lower seat 3 so that the two guide rollers 1 will not be vibrated or deflected by the two pull cords 13 and will be rotated smoothly and stably by guidance of the two shafts 31 and the two annular grooves 32 of the lower seat 3.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An auto winding mechanism for a window blind, comprising:

an upper seat;

a lower seat connected with the upper seat;

two guide rollers pivotally mounted between the upper seat and the lower seat;

two pull cords wound around the two guide rollers in two opposite directions; and an S-shaped elastic winding tape; wherein:

each of the two guide rollers has an upper end connected with the S-shaped elastic winding tape and a lower end connected with a respective one of the two pull cords;

each of the two guide rollers has a periphery provided with a gear, with the S-shaped elastic winding tape located intermediate the gear and the upper seat;

the gears of the two guide rollers mesh with each other, with the two guide rollers rotated in concert with each other;

each of the two guide rollers has a bottom provided with a bottom disk;

the upper seat has a surface provided with two pivot holes;

the lower seat has a surface facing the upper seat, with two annular grooves extending from the surface to a depth away from the upper seat and receiving the bottom disk of each of the two guide rollers, with the lower seat provided with two shafts extending through the two guide rollers and aligning with the two pivot holes of the upper seat;

each of the two shafts of the lower seat is located in a respective one of the two annular grooves of the lower seat;

the two guide rollers are pivotally mounted on the two shafts of the lower seat with the gears of the two guide rollers meshing with each other;

the bottom disk of each of the two guide rollers is pivotally mounted in a respective one of the two annular grooves of the lower seat;

each of the two guide rollers is limited between the respective shaft and the respective annular groove of the lower seat, with each of the two guide rollers rotatable on the lower seat smoothly and stably without producing vibration or deflection;

the upper seat is mounted on the lower seat, with the two pivot holes of the upper seat aligning with the two shafts of the lower seat;

the two pivot holes of the upper seat and the two shafts of the lower seat are connected with the upper seat combined with the lower seat;

the gear of each of the two guide rollers is disposed above the bottom disk of each of the two guide rollers;

each of the two pull cords is disposed under the gear of each of the two guide rollers and is disposed above the bottom disk of each of the two guide rollers;

each of the two pull cords is limited between the upper seat and the bottom disk of a respective one of the two guide rollers and between the surface of the lower seat and the gear of the respective one of the two guide rollers;

the bottom disk of each of the two guide rollers has a thickness equal to a depth of the respective annular groove of the lower seat;

the bottom disk of each of the two guide rollers limits and prevents each of the two pull cords from being moved downward away from the gear; and the bottom disk of each of the two guide rollers is received in and has a diameter flush with that of the respective annular groove of the lower seat and without a clearance between the bottom disk of each of the two guide rollers and the respective annular groove of the lower seat to prevent each of the two pull cords from being jammed between the bottom disk of each of the two guide rollers and the respective annular groove of the lower seat.

2. The auto winding mechanism for a window blind of claim 1, further comprising a covering edge extending from the surface of the upper seat towards the surface of the lower seat to a height but spaced from the surface of the lower seat, with the gears of the two guide rollers being spaced from the surface of the upper seat less than the height, with the covering edge surrounding the gear of each of the two guide rollers, with each of the two pull cords disposed between the covering edge and the surface of the lower seat, and wherein the covering edge of the upper seat covers the gear of each of the two guide rollers completely to limit and prevent each of the two pull cords from being moved upward and to prevent each of the two pull cords from being jammed with the gear of each of the two guide rollers.

3. The auto winding mechanism for a window blind of claim 1, wherein the bottom disk of each of the two guide rollers has a diameter greater than a winding diameter of each of the two pull cords around each of the two guide rollers.

4. The auto winding mechanism for a window blind of claim 3, further comprising a covering edge extending from the surface of the upper seat towards the surface of the lower seat to a height but spaced from the surface of the lower seat, with the gears of the two guide rollers being spaced from the surface of the upper seat less than the height, with the covering edge surrounding the gear of each of the two guide rollers, with each of the two pull cords disposed between the covering edge and the surface of the lower seat, and wherein the covering edge of the upper seat covers the gear of each of the two guide rollers completely to limit and prevent each of the two pull cords from being moved upward and to prevent each of the two pull cords from being jammed with the gear of each of the two guide rollers.

5. The auto winding mechanism for a window blind of claim 3, wherein the lower seat has a periphery provided with a plurality of mounting posts, the upper seat has a periphery provided with a plurality of through holes mounted on the mounting posts of the lower seat, and the auto winding mechanism further comprises a plurality of mounting sleeves mounted on the mounting posts of the lower seat and located between the upper seat and the lower seat, with the two guide rollers pivotally mounted between the upper seat and the lower seat stably.

6. The auto winding mechanism for a window blind of claim 5, wherein the lower seat has a rim provided with a plurality of upward extending limit plates aligning with the mounting sleeves, and each of the two pull cords is extended and limited between a respective one of the mounting sleeves and a respective one of the limit plates.

7. The auto winding mechanism for a window blind of claim 5, further comprising a plurality of limiting bars mounted between the upper seat and the lower seat and aligning with the mounting sleeves, and each of the two pull cords is extended and limited between a respective one of the mounting sleeves and a respective one of the limiting bars.

8. The auto winding mechanism for a window blind of claim 7, further comprising a covering edge extending from the surface of the upper seat towards the surface of the lower seat to a height but spaced from the surface of the lower seat, with the gears of the two guide rollers being spaced from the surface of the upper seat less than the height, with the covering edge surrounding the gear of each of the two guide rollers, with each of the two pull cords disposed between the covering edge and the surface of the lower seat, and wherein the covering edge of the upper seat covers the gear of each of the two guide rollers completely to limit and prevent each of the two pull cords from being moved upward and to prevent each of the two pull cords from being jammed with the gear of each of the two guide rollers.

* * * * *